United States Patent [19]

Sharp

[11] Patent Number: 4,998,647

[45] Date of Patent: Mar. 12, 1991

[54] DETACHABLE DISPENSER AND HANGING SUPPORT

[76] Inventor: Peggy Sharp, Box 1632, Soquel, Calif. 95073

[21] Appl. No.: 405,681

[22] Filed: Sep. 8, 1989

[51] Int. Cl.[5] ..... B67D 5/60

[52] U.S. Cl. ..... 222/143; 222/132; 222/181; 222/518; 211/113

[58] Field of Search ..... 222/173, 181, 185, 192, 222/129, 132, 143, 518; 206/77.1; 141/106, 363, 364; 248/206.3; 211/113, 119; 239/289, 305

[56] References Cited

U.S. PATENT DOCUMENTS

| | | | |
|---|---|---|---|
| 3,181,702 | 5/1965 | Raphael | 211/119 |
| 3,194,426 | 7/1965 | Brown, Jr. | 222/143 |
| 4,541,131 | 9/1985 | Sussman | 211/113 |

FOREIGN PATENT DOCUMENTS

| | | | |
|---|---|---|---|
| 462855 | 7/1928 | Fed. Rep. of Germany | 222/181 |
| 2164633 | 3/1986 | United Kingdom | 222/181 |

*Primary Examiner*—Andres Kashnikow
*Assistant Examiner*—Anthoula Pomrening
*Attorney, Agent, or Firm*—Jeffrey A. Hall

[57] ABSTRACT

A detachable multi-unit dispenser and hanging support has detachable containers with cone shaped filling units therein. Each unit has a normally closed, operable valve which controls an outlet in each container. A removable platform for placing soap, brushes, sponges and the like is detachably secured to the bottom of the dispenser by suction cups. Hooks are provided for hanging razors, washcloths, swimwear and the like on the platform. An adjustable strap with securing buckle is provided for attachment to a support surface. In another embodiment said strap has mating hook and loop fasteners for looping around and attachment to the support surface.

8 Claims, 2 Drawing Sheets

DETACHABLE DISPENSER AND HANGING SUPPORT

BACKGROUND OF THE INVENTION

1. Field of Invention

This invention relates to dispensers, and more particularly to detachable dispensers of powders and liquids which also serve as a support for razors, brushes, soap and the like, for use in showers, baths, saunas, and other applications.

2. Description of Prior Art

Many, if not most individuals while taking a shower, bath, sauna or the like, use a number of different fluids, powders, and mechanical devices such as razors, sponges and brushes. A common problem encountered is the organization and dispension of such items in, for example, a shower where typically a steady stream of water rains down while steam and water drops obstruct one's view. Another problem is where to place the containers and articles. Typically a soap dish or ledge surrounding the shower and bath is all the convenient space available. Still another problem is how to store and dispense items in a shower or bath when the shower, for example, is shared with children. In such circumstances items such as razors resting on a shower ledge can become a potential hazard. Furthermore, in such situations it would be desirable to have control over the amount of soap, conditioner, toothpaste and the like, which a child can self-dispense.

Heretofore a wide variety of devices have been proposed and implemented for fluid and particle dispension.

An example of such device is shown in U.S. Pat. No. 3,078,016 to Judy. This device consists of a screw mounted dispensing unit for fluids. Such device is of limited usefullness due to the inability to adjust its position on a support surface, lack of hanging space available for useful articles, and the absence of control over the volume of fluid dispensed.

Another type of wall dispensing unit is disclosed in U.S. Pat. No. 4,039,104 to Migares, et.al. This device is a wall mounted, multipleunit dispenser including two side by side containers with valves for dispensing liquids. The device is mounted on a wall bracket which limits its applicability due to its fixation in one position on a wall prohibiting vertical adjustment. This type of attachment, especially in tile or plaster, results in an essentially permanent installation. Furthermore, such type of dispenser has no support space for hanging or organizing items such as sponges, brushes, razors and the like.

A still different approach to wall mounted liquid dispensers is seen in U.S. Pat. No. 4,793,517 to Washnut. Such device consisted of a resilient container for liquids with three compartments. A valve controls a port in each of said compartments. A vacuum cup fastener is disclosed to facilitate fixation on a support surface such as a bathroom wall. Although this device is easily repositioned and portable, its usefulness is restricted due to its sole function, i.e. dispensing liquids. No provisions are made for holding, supporting, or organizing articles such as brushes, sponges, razors and the like.

Therefore, it would be highly desirable to have a device which dispenses, in controlled amounts, liquids and powders, which is easily attached and removed from a support, which can be adjusted vertically while remaining fixed to said support, and which provides means for hanging, storing, and organizing items such as razors, combs, brushes, sponges, soap, and the like.

OBJECTS AND ADVANTAGES

Accordingly several objects and advantages of the present invention are:

(a) to provide a portable, adjustable, liquid and powder dispenser for attachment on a support surface;

(b) to provide such a dispenser which may be adjusted vertically without removing the dispenser from said support surface;

(c) to provide such a dispenser which has a sloped top surface to prevent pooling of water thereon;

(d) to provide such a dispenser which has detachable compartments for fluids or powders to facilitate cleaning, filling and the like;

(e) to provide such a dispenser with funnel filling units so that said compartments may be filled by inverting a bottle or container therein thereby avoiding manual filling, if so desired;

(f) to provide such a dispenser with means for holding razors, toothbrushes and the like;

(g) to provide such a dispenser with a line for hanging washcloths, clothing or the like; and (h) to provide such a dispenser with a support rack for holding soap, scrub brushes, sponges and similar items.

Further objects and advantages are to provide a portable and adjustable dispensing and hanging support that can be used easily and conveniently, which is easy to clean, which is simple and easy to fill, which dispenses controlled amounts of liquid or powder, which is easy to store, and which is simple and inexpensive to manufacture. Still further objects and advantages will become apparent from a consideration of the ensuing description and drawings.

DETAILED DESCRIPTION OF A PREFERRED EMBODIMENT

Figure 1:
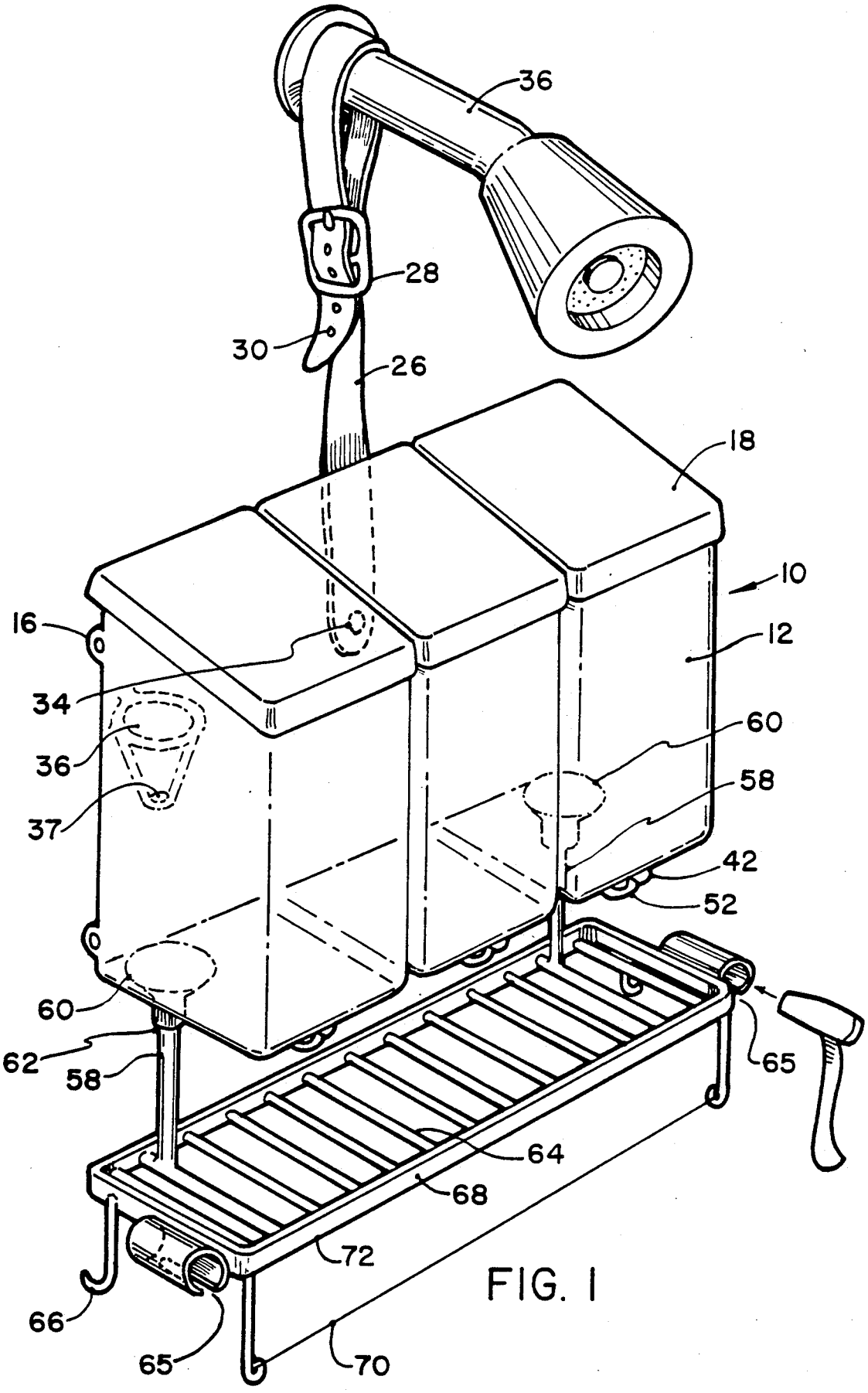
FIG. 1 shows a perspective view of the detachable dispenser and hanging support according to the preferred embodiment of the invention.
Figure 4:
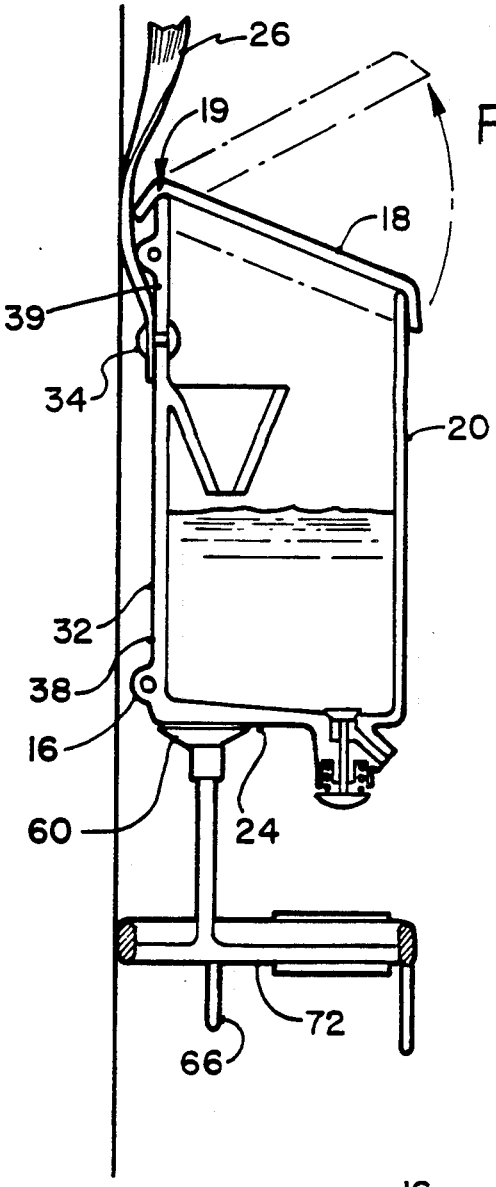
FIG. 4 shows a vertical sectional view of such dispenser and support.
Figure 3:
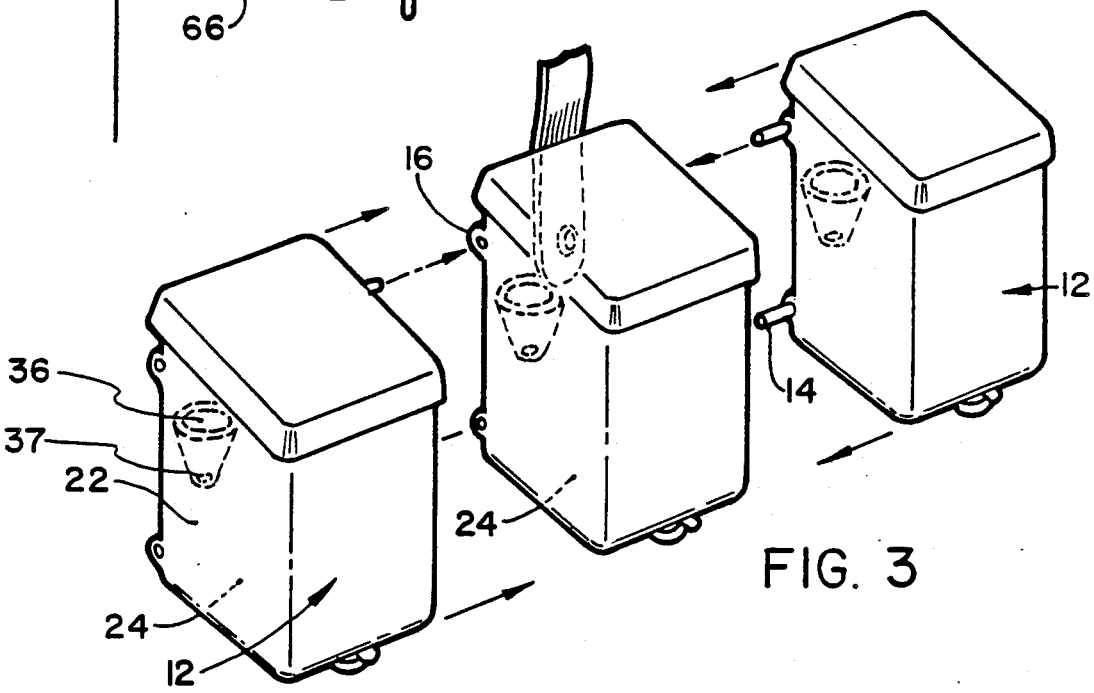
FIG. 3 shows a top perspective view of the container units in position to be attached together.

FIG. 1 shows a detachable dispenser and hanging support 10 according to the preferred embodiment of the invention. The dispenser comprises a plurality of detachable container units 12 which when joined form a multiple unit dispenser. The container units 12 are held together by a plurality of slideably connectable rails 14 which fit into a plurality of corresponding track 16 members on the adjacent unit as shown in FIGS. 1 and 3. Each container 12 has at a predetermined position a plurality of said rail and tracks which are adapted to and connectably fit with an opposite member in the adjacent unit. For example, rail 14 slides into a track 16 on an adjacent unit. In the preferred embodiment multiple unit dispenser 10 is composed of three side-by-side container units 12. The containers are essentially rectangular, but may be different. Each container 12 has a sloped top with a hinge 19, a back wall 32, a front wall 20, a pair of elongated side walls 22, and a sloped bottom face 24. The front wall 20 has a lower wall portion and the back wall 32 has a lower wall portion 38, and an upper wall portion 39. The connecting rails 14 and tracks 16, in the preferred embodiment, are positioned on the lower wall portion 38 and the upper wall portion 39 of back wall 32. Although this is the preferred placement of said rails 14 and tracks 16 alternative positioning is possible. The essential feature is that a detachably connected joining is made between the container units 12.

For securing the multi-unit dispenser 10 to a wall an adjustable strap 26 with buckle 28 and holes 30 is affixed to the dispenser 10, preferably on the back wall 22 of one of the units 12. Alternatively, said strap 26 may be affixed to top face 18. The strap 26 is joined to the dispenser 10 by a conventional rivet 34, or may be joined by screw, glue or the like as is well known in the art. The strap 26, may alternatively, have in place of said buckle, a fastening mechanism of opposing pieces of hook and loop fasteners attached thereto for conveniently forming a securing loop for hanging said dispenser to a support surface such as a shower neck pipe 36. With either embodiment it can be seen that a simple and convenient means is provided for hanging dispenser 10 from any surface around which strap 26 can form a securing loop.

Each container 12 has a essentially cone-shaped funnel 36 provided for facilitating draining bottles into the container 12. In the preferred embodiment funnel 36 with an opening 37 is formed integrally within container 12 as illustrated in FIG. 1 preferably in a corner section defined by wall 32 and side wall 22, thereby providing an easy and convenient means to fill the containers. In an alternative embodiment funnel 36 is molded integrally with top face 18.

Figure 2:
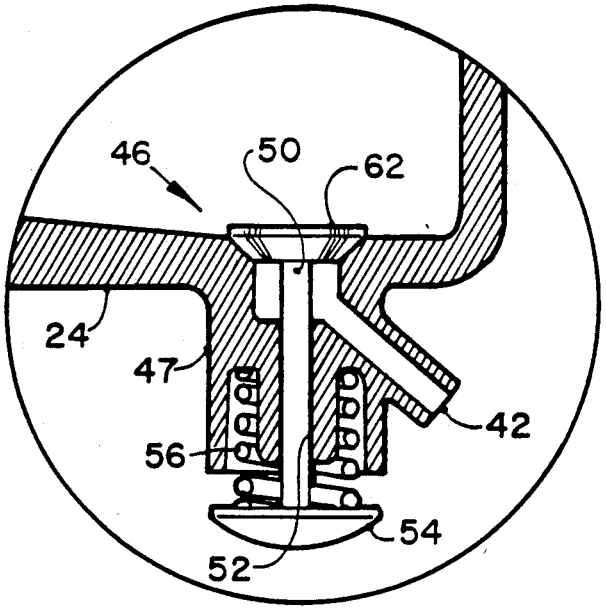
FIG. 2 shows an exploded view of spring hinged valve according to the invention.

The lower front wall is provided with an outlet opening 42 in which there is disposed a spring hinged valve assembly generally referred to by the reference numeral 46. With attention now to FIG. 2 of the drawings it will be noted that valve assembly 46 includes a sleeve seat 47 with an opening 42, so that a valve member 50 of the valve assembly 46 is slidingly received in a sleeve member 52. The valve member 50 is also provided with a diametrically enlarged head portion 54 slideably urged into seated functional engagement with the sleeve member 47 by means of a compression spring 56. Pressure within container 12 will move valve member 50 outwardly through the sleeve 47 against the thrust of compression spring 56 to enable the fluid or powder within the container to be dispensed therefrom when head 54 is pushed inward toward container 12.

A detachable platform 64 with a lip edge 68 and a undersurface 72 is provided for placing soap, brushes and the like, and for hanging articles such as razors and washcloths. Said platform 64 is detachably fastened to containers 12 by a plurality of legs 58 secured to platform 64. Said legs have a suction cup 60 permanently attached to a upper end of the legs 62 for fastening to the bottom face 24 of the containers 12. The platform 64 in the preferred embodiment is made of plastic mesh or related material to prevent the pooling of water thereon.

A plurality of hooks 66 are placed along the edges and underside of said platform 64. A razor holder with a slot 65 for safety and conveniently storing razors is also provided. Said hooks provide a convenient means to hold and store towels, brushes and the like, and if desired, to hook a line 70 between two such hooks for hanging washcloths, hairnets, swimming suits and the like, beneath the platform 64.

A dispenser and support hanger according to the invention made of plastic, or non-metallic resilient material, has the advantage of durability, inexpensiveness of manufacture, and resistance to rust and oxidation.

OPERATION

A method of using a detachable dispenser and hanging support device according to the invention can include first looping adjustable strap 26 around a shower head neck. Vertical height may be adjusted by shortening or lengthening said strap by placement of strap buckle 28 in strap holes 30, and by the choice of hole placed in, either lengthen or shorten the strap length 30 in a conventional manner.

Next containers 12 may be filled by opening top face 18 and inverting an open bottle of shampoo, for example, into funnel 36. Containers may be joined to one another by sliding rails 14 of a detached container into tracks 16 of another container 12. In this manner container units may be added or detached easily and simply, and if so desired, removed for convenient cleaning.

The detachable platform 64 may be secured to dispenser 10 by fixing suction cups 60 to the bottom face 24 of the containers. If the dispenser 10 is to be stored or packed for travel said platform 62 may be simply and conveniently detached by loosening suction cups from bottom face 24 thereby detaching platform 64.

In use, platform 64 is provided with a plurality of hooks 66 and slot 65 for hanging brushes, razors, sponges and the like as illustrated in FIG. 1. Two hooks may be attached to the under surface 72 of platform 64 in such a manner that a clothes line 70 may be tied thereto for hanging washcloths, swimwear and the like.

When the user wishes to release fluid from container 12, valve assembly 46 is pressed inward and fluid is dispensed. For example, if the user wishes to shampoo, the container 12 with shampoo within would be activated by pressing assembly 46 with the users hand held underneath. If the user wished to hang a razor, for example, hooks 66 or slot 65 could be used to hold the razor. Alternatively, the razor could be placed on platform 64 for temporary storage.

While the above description contains many specificities, the reader should not construe these as limitations in the scope of the invention, but merely as exemplifications of preferred embodiments thereof. Those skilled in the art will readily be able to envision many other possible variations are within its scope. For example, skilled artisans will readily be able to change the dimensions and shapes of the various embodiments. They will be able to make the dispenser out of alternative materials such as metal or urethane. They can make variations in the hanging mechanism such as using suction discs to hang the dispenser on a support surface. They can vary the placement of hooks or the type of support surface used. Accordingly the reader is requested to determine the scope of the invention by the appended claims and their legal equivalents, and not by the examples which have been given.

What is claimed is:

1. A multi-unit dispenser and hanging support for use in showers, and bathrooms, comprising:

a plurality of generally rectangular containers, each with a sloped top, a sloped bottom face, a front wall, a back wall, a pair of side walls, said front wall having a lower front wall portion, said back wall having a lower wall portion and an upper wall portion, said containers having a plurality of rails and a plurality of tracks on said lower and upper portion of the back wall so as to detachably secure said containers to one another, each container having a cone shaped filling funnel formed integrally therein, and an outlet opening having a valve means associated with said outlet opening, an adjustable strap with fastening means affixed onto the back wall of the container, and a detachable platform with a plurality of legs each secured at one end to said platform with an upper end having a suction cup affixed thereto for joining said platform to the bottom face of said containers, said platform having a plurality of hooks secured thereto for hanging razors, brushes, and washcloths.

2. The dispenser and hanging support of claim 1 wherein said valve means comprises a spring urged valve assembly.

3. The dispenser and hanging support of claim 1 wherein said fastening means comprises a strap buckle and a plurality of holes in said strap for adjustably securing said strap to a support surface.

4. The dispenser and hanging support of claim 1 wherein said support is composed of non-metallic resilient material.

5. A detachable multi-unit dispenser, comprising:

a plurality of detachable containers, each with a sloped top, a sloped bottom face, a front wall, a back wall, a pair of side walls, said front wall with a lower front wall portion, said back wall with a lower back wall portion and an upper back wall portion, having a plurality of rails and a plurality of tracks extending along said lower and upper back wall portion so as to detachably secure said containers to one another, a cone shaped filling funnel formed integrally within said containers, the containers having an outlet opening and a valve means associated with said outlet opening, an adjustable strap with fastening means, secured onto the back walls of said containers, and a detachable platform having a plurality of legs, each secured at one end to said platform with a upper end having a suction cup affixed thereto for joining said platform to the bottom face of said container, said platform having a plurality of hooks attached thereto for hanging razors, brushes, and washcloths.

6. The multi-unit dispenser of claim 5 wherein said valve means comprises a spring urged valve assembly.

7. The multi-unit dispenser of claim 5 wherein said fastening means comprises a strap buckle and a plurality of holes placed throughout said strap for adjustably securing said strap to a support surface.

8. The multi-unit dispenser of claim 5 wherein said dispenser is composed of non-metallic resilient material.

* * * * *